US010247531B1

(12) United States Patent
Hall et al.

(10) Patent No.: US 10,247,531 B1
(45) Date of Patent: Apr. 2, 2019

(54) MONOLITHIC FRAGMENTATION CASING

(71) Applicant: The United States of America as represented by the Department of the Navy, Washington, DC (US)

(72) Inventors: Ian Avalon Hall, Rockville, MD (US); Kevin Genson, Waldorf, MD (US)

( * ) Notice: Subject to any disclaimer, the term of this patent is extended or adjusted under 35 U.S.C. 154(b) by 0 days.

(21) Appl. No.: 15/330,511

(22) Filed: Sep. 30, 2016

(51) Int. Cl.
*F42B 12/22* (2006.01)
*F42B 12/28* (2006.01)
*F42B 12/76* (2006.01)

(52) U.S. Cl.
CPC ..... *F42B 12/76* (2013.01); *F42B 12/22* (2013.01); *F42B 12/28* (2013.01)

(58) Field of Classification Search
CPC ..... F42B 12/20; F42B 12/22; F42B 12/28; F42B 12/32; F42B 12/74; F42B 12/76
USPC ..... 102/491, 494, 495, 496
See application file for complete search history.

(56) References Cited

U.S. PATENT DOCUMENTS

| | | | | |
|---|---|---|---|---|
| 3,298,308 | A | 1/1967 | Throner, Jr. | |
| 3,820,464 | A | 6/1974 | Dixon | |
| 4,106,410 | A | 8/1978 | Borcher et al. | |
| 4,129,061 | A * | 12/1978 | Bedall | F42B 12/32 102/496 |
| 4,592,283 | A * | 6/1986 | Hellner | F42B 12/22 102/493 |
| 5,535,679 | A * | 7/1996 | Craddock | F42B 12/32 102/389 |
| 9,541,363 | B2 * | 1/2017 | Burky | F42B 12/22 |
| 2016/0178336 | A1 * | 6/2016 | Jennett | F42B 12/207 102/506 |

* cited by examiner

*Primary Examiner* — James S Bergin
(74) *Attorney, Agent, or Firm* — Fredric J. Zimmerman

(57) ABSTRACT

A fragmentation casing includes a monolithic tube defined by an alternating axial arrangement of first and second rings. Each first ring is a contiguous ring of fused powder defining spaced-apart first elements of the fused powder and at least one second element of the fused powder joining adjacent ones of the first elements. Each second ring is a contiguous lattice of the fused powder. Each of the first elements is contiguous with a portion of the lattice associated with at least one of the second rings.

13 Claims, 2 Drawing Sheets

MONOLITHIC FRAGMENTATION CASING

ORIGIN OF THE INVENTION

The invention described herein was made in the performance of official duties by an employee of the Department of the Navy and may be manufactured, used, licensed by or for the Government for any governmental purpose without payment of any royalties thereon.

FIELD OF THE INVENTION

The invention relates generally to fragmentation casings, and more particularly to a monolithic fragmentation casing and method for making same.

BACKGROUND OF THE INVENTION

Conventional approaches to controlled warhead fragmentation rely on either preformed fragments or case scoring to induce shear stress concentrations. The disadvantages of using preformed fragments include the difficulty associated with assembling the preformed fragments in a warhead case and the lack of any strength members. Furthermore, preformed fragments must be backed with or adhered to a liner that retains the fragments and acts as a support structure during launch and impact events. The use of liners results in large amounts of parasitic mass, uneven fragment distribution, low fragment velocity, and poor strength. Case scoring or notching is limited by its manufacturability to only a small range of warhead shapes and fragment sizes. Internal scoring can only be done in a helical or linear pattern and the fragments cannot be individually sized and shaped.

SUMMARY OF THE INVENTION

Accordingly, it is an object of the present invention to provide a fragmentation casing and method for making same.

Another object of the present invention is to provide a monolithic fragmentation casing and method for making same where the casing includes pre-formed fragments.

Other objects and advantages of the present invention will become more obvious hereinafter in the specification and drawings.

In accordance with the present invention, a fragmentation casing includes a monolithic tube defined by an alternating axial arrangement of first rings and second rings. Each of the first rings is a contiguous ring of fused powder defining spaced-apart first elements of the fused powder and at least one second element of the fused powder joining adjacent ones of the first elements. Each second element is smaller than each of the first elements. Each of the second rings is a contiguous lattice of the fused powder wherein each of the first elements is contiguous with a portion of the lattice associated with at least one of the second rings.

BRIEF DESCRIPTION OF THE DRAWINGS

Other objects, features and advantages of the present invention will become apparent upon reference to the following description of the exemplary embodiments and to the drawings, wherein corresponding reference characters indicate corresponding parts throughout the several views of the drawings and wherein.

DETAILED DESCRIPTION OF THE INVENTION

Figure 1:
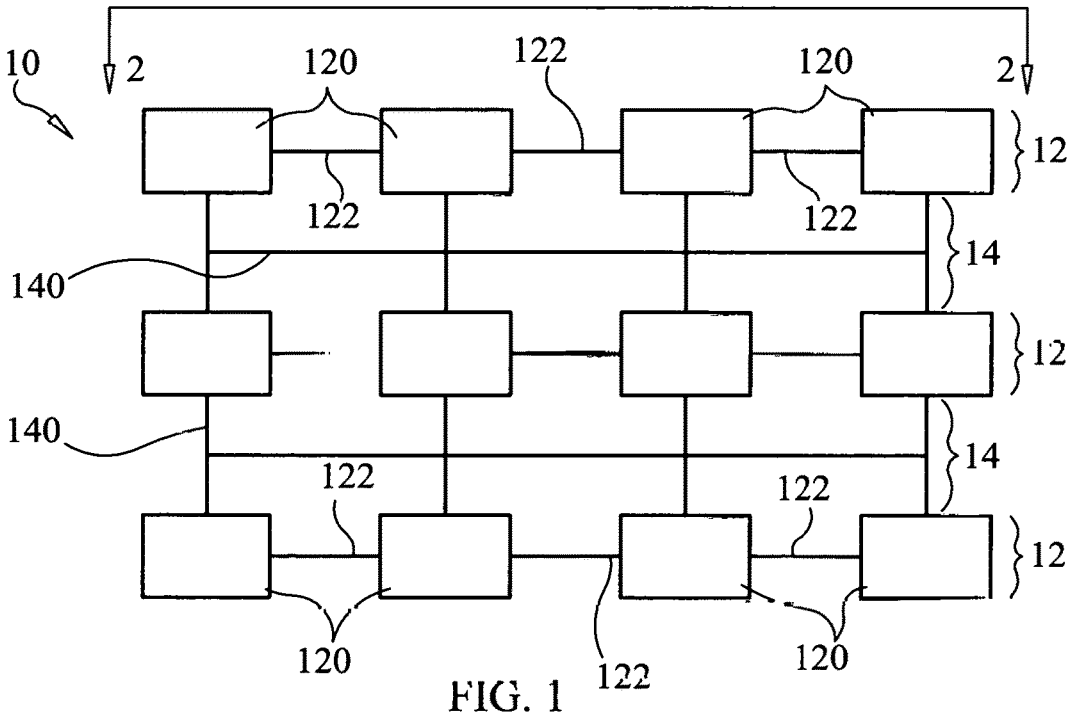
FIG. 1 is a side view of a monolithic fragmentation casing in accordance with an embodiment of the present invention.
Figure 2:
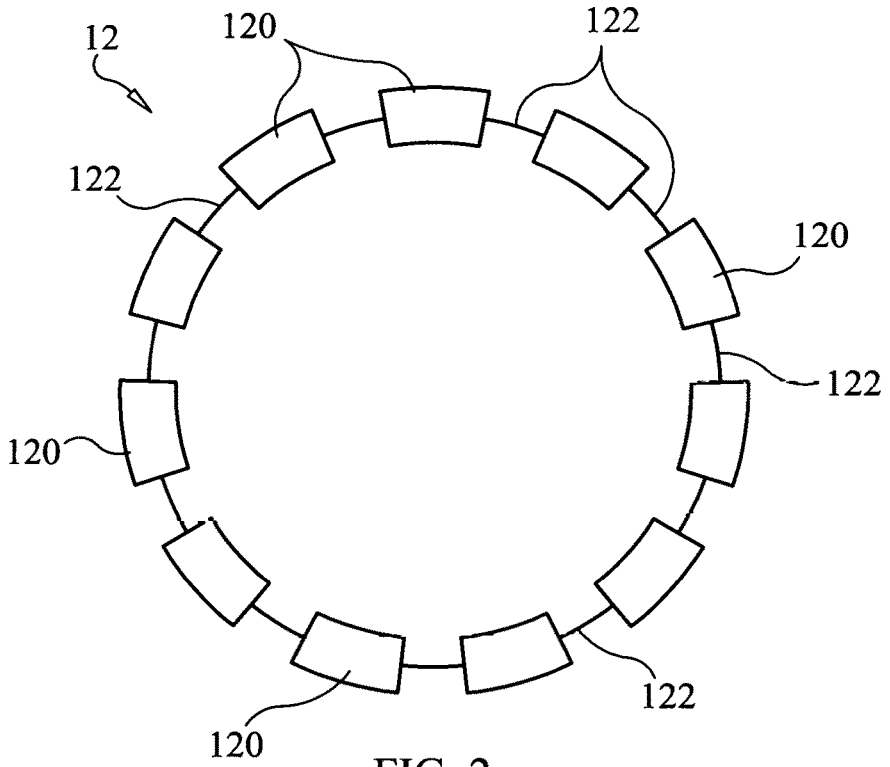
FIG. 2 is an end view of the monolithic fragmentation casing taken along line 2-2 in FIG. 1.

Referring now to the drawings, simultaneous reference will be made to FIGS. 1 and 2 where a monolithic fragmentation casing in accordance with an exemplary embodiment of the present invention is shown and is referenced generally by numeral 10. In the illustrated embodiment, casing 10 is a hollow tubular structure that is open at either axial end thereof. As would be understood in the art, the hollow region defined by casing 10 is generally filled with explosive materials (not shown). The choice of explosive material(s) and the configuration or arrangement thereof within casing 10 is not a limitation of the present invention.

Casing 10 is a monolithic tubular structure of connected solid elements that define an axial arrangement of alternating ring structures 12 and 14. The number of ring structures used is not a limitation of the present invention. Each of ring structures 12 is a contiguous ring of spaced-apart fragmentation elements or bodies 120 with adjacent ones of fragmentation elements being linked or joined by a connector 122 that is considerably smaller than fragmentation elements 120. Each of ring structures 14 is a contiguous lattice 140. Each fragmentation element 120 is linked or joined to a portion of lattice 140 from at least one of ring structures 14. The shape and size of each of fragmentation elements 120, connectors 122, and lattice 140 are not limitations of the present invention.

Fabrication of casing 10 may be accomplished using an additive manufacturing process known as powder bed fusion. Since casing 10 will form part of a fragmentation projectile, warhead, missile, etc., casing 10 may generally be made from a metal material. Such metals may include aluminum, titanium, steel, stainless steel, Inconel, tungsten, copper, brass, zirconium, magnesium, tantalum, and alloys thereof. However, it is to be understood that the present invention is not limited to the use of these metals as any metal, plastic, etc., that lends itself to use in a powder bed fusion process may be used.

In a powder bed fusion process, a fusable material (e.g., metal) is provided in a powdered state. In general, a powder bed fusion process involves an electromagnetic beam of radiation (e.g., laser beam, electron beam, etc.) being directed towards the bed of fusable powder in accordance with a prescribed plan such that the fusable powder solidifies into a solid state to define a solid part. The unfused powder is discarded as the finished solid casing 10 is removed from the powder bed.

Figure 3:
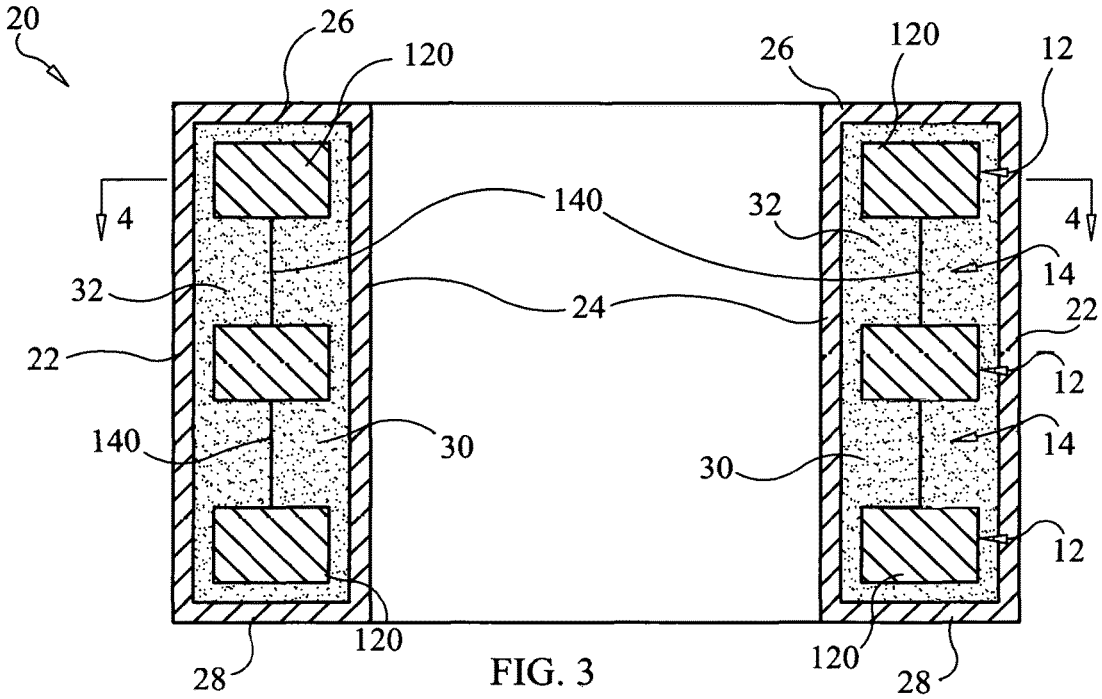
FIG. 3 is an axial cross-sectional view of a monolithic fragmentation casing in accordance with another embodiment of the present invention.
Figure 4:
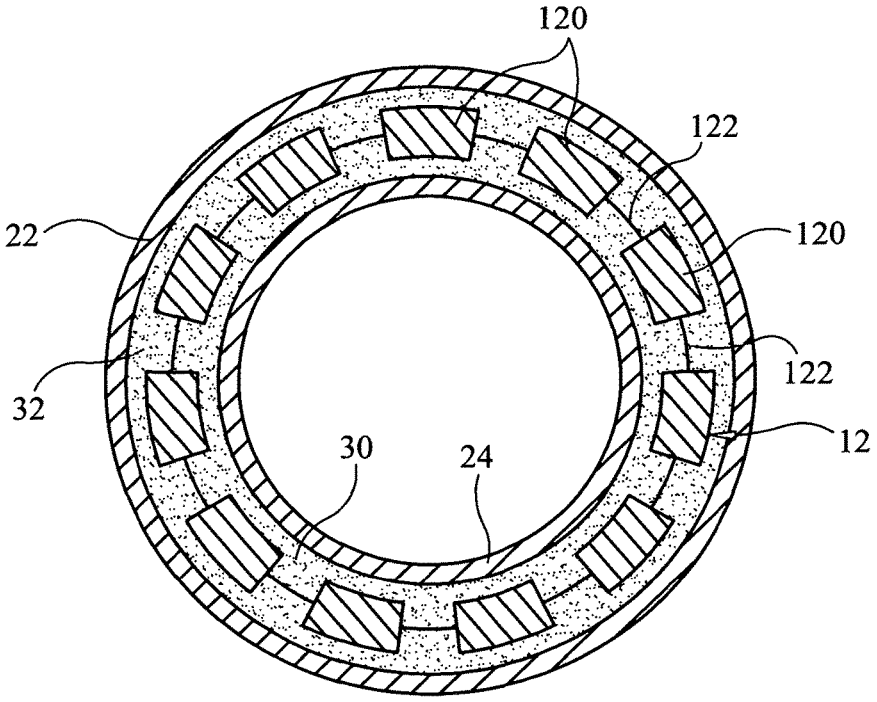
FIG. 4 is a radial cross-sectional view of the monolithic fragmentation casing taken along line 4-4 in FIG. 3.

Another exemplary embodiment of the present invention is shown in FIGS. 3-4 where a casing 20 is a tubular structure having the basic alternating ring structure described above for casing 10 encased within a tubular wall structure. More specifically, casing 20 includes an outer radial wall 22, an inner radial wall 24 spaced radially from outer radial wall 22, and axial end walls 26 and 28 that are contiguous with outer and inner radial walls 22 and 24, respectively. The region between inner radial walls defines a tubular region that would generally be filled with explosive materials (not shown). Each of walls 22-28 may be solid throughout their thickness dimension. As a result of this construction, walls 22-28 define an annular chamber 30 with interstices being defined between walls 22-28 and ring structures 12 and 14. Thus, a monolithic casing structure 20 is formed.

When casing 20 is fabricated using a powder bed fusion process in accordance with the present invention, the interstices within annular chamber 30 adjacent to ring structures 12 and 14 remain completely filled with unfused, fusable powder 32 (e.g., metal powder). That is, ring structures 12/14 and walls 22-28 are defined by the fused (solid) form of fusable powder 32. Thus, casing 20 is made completely from the same material as ring structures 12/14 and walls 22-28 are the solid state of powder 32, while the interstices in chamber 30 surrounding walls 22-28 and ring structures 12/14 remain as unfused, fusable powder 32. In terms of a fragmentation casing, the retention of powder 32 in the interstices serves to provide improved protection of the fragments in the ring structures 12 from the shock of detonation of the explosive fill, provide localized blast effects from movement of the metal powder, and also may provide incendiary effects if the powder is reactive.

The advantages of the present invention are numerous. The fragmentation casing's solid monolithic portion has structural integrity and defined regions of fragmentation. When included, the casing's powder portion provides enhanced localized blast and potentially incendiary effects. The single manufacturing process for making the casing from a single material avoids manufacturing defects and costs that are inherent to conventional manufactured casings made from multiple materials must be assembled.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

Finally, any numerical parameters set forth in the specification dud attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should be at least construed in light of the number of significant digits and by applying ordinary rounding.

What is claimed as new and desired to be secured by Letters Patent of the United States is:

1. A fragmentation casing, comprising:

a monolithic tube being defined by an alternating axial arrangement of first rings and second rings, each of said first rings being a contiguous ring of fused powder defining spaced-apart first elements of said fused powder and at least one second element of said fused powder joining adjacent ones of said spaced-apart first elements, wherein each of said at least one second element is smaller than each of said spaced-apart first elements, and each of said second rings being a contiguous lattice of said fused powder, wherein each of said spaced-apart first elements is contiguous with a portion of said contiguous lattice associated with at least one of said second rings.

2. The fragmentation casing as in claim 1, wherein said fused powder originates from a bed of a fusable powder material.

3. The fragmentation casing as in claim 1, wherein said fused powder comprises a metal selected from the group consisting of aluminum, titanium, steel, stainless steel, Inconel, tungsten, copper, brass, zirconium, magnesium, tantalum, and alloys thereof.

4. The fragmentation casing as in claim 1, further comprising an outer casing of said fused powder encasing said tube wherein interstices are defined adjacent to at least portions of said contiguous lattice, said spaced-apart first elements, and each of said at least one second element; and a powder material filling said interstices, wherein said powder material and said fused powder are each comprised of identical materials.

5. The fragmentation casing as in claim 4, wherein said identical material is selected from the group consisting of aluminum, titanium, steel, stainless steel, Inconel, tungsten, copper, brass, zirconium, magnesium, tantalum, and alloys thereof.

6. A fragmentation casing, comprising:

a monolithic tube being defined by an alternating axial arrangement of first rings and second rings, each of said first rings being a contiguous ring of fused powder defining spaced-apart fragmentation elements and a connector joining adjacent ones of said fragmentation elements, and each of said second rings being a contiguous lattice of said fused powder, wherein each of said spaced-apart fragmentation elements is contiguous with a portion of said contiguous lattice associated with at least one of said second rings.

7. The fragmentation casing as in claim 6, wherein said fused powder originates from a bed of a fusable powder material.

8. The fragmentation casing as in claim 6, wherein said fused powder comprises a metal selected from the group consisting of aluminum, titanium, steel, stainless steel, Inconel, tungsten, copper, brass, zirconium, magnesium, tantalum, and alloys thereof.

9. The fragmentation casing as in claim 6, further comprising:

an outer casing of said fused powder encasing said tube wherein interstices are defined adjacent to at least portions of said contiguous lattice, said spaced-apart fragmentation elements, and each said connector; and a powder material filling said interstices, wherein said powder material and said fused powder are each comprised of identical materials.

10. The fragmentation casing as in claim 9, wherein said identical materials are a metal selected from the group consisting of aluminum, titanium, steel, stainless steel, Inconel, tungsten, copper, brass, zirconium, magnesium, tantalum, and alloys thereof.

11. A method of making a fragmentation casing, comprising:

providing a bed of fusable powder; and directing a laser beam at said bed for causing a portion of said fusable powder to solidify for defining a monolithic tube being made from a solid material form of said fusable powder, wherein said monolithic tube defined by an alternating axial arrangement of first rings and second ringo, each of said first rings being a contiguous ring defining spaced-apart fragmentation elements and a connector joining adjacent ones of said spaced-apart fragmentation elements, and each of said second rings being a contiguous lattice, wherein each of said spaced-apart fragmentation elements is contiguous with a portion of said contiguous lattice associated with at least one of said second rings.

12. The method according to claim 11, wherein said fusable powder comprises a metal powder selected from the group consisting of aluminum, titanium, steel, stainless steel, Inconel, tungsten, copper, brass, zirconium, magnesium, tantalum, and alloys thereof.

13. The method according to claim 11, further comprising directing said laser beam at said bed for causing another portion of said fusable powder to solidify for defining an outer casing being made from a solid form of said fusable powder, wherein said outer casing encases said tube where interstices are defined adjacent to at least portions of said contiguous lattice, said spaced-apart fragmentation elements, and each said connector, and wherein said fusable powder fills said interstices.

* * * * *